United States Patent [19]

Watson

[11] Patent Number: 4,893,787

[45] Date of Patent: Jan. 16, 1990

[54] FENCE CORNER POST

[76] Inventor: Terry D. Watson, P.O. Box 374, Cheyenne, Okla. 73628

[21] Appl. No.: 159,719

[22] Filed: Feb. 24, 1988

[51] Int. Cl.[4] ..... E04H 17/02

[52] U.S. Cl. ..... 256/35; 256/22; 256/DIG. 5; 52/152; 52/154

[58] Field of Search ..... 256/35, 36, 22, DIG. 5, 256/65; 52/152, 154, 153

[56] References Cited

U.S. PATENT DOCUMENTS

| | | | |
|---|---|---|---|
| 204,565 | 6/1878 | Hartley et al. | 256/DIG. 5 X |
| 625,278 | 5/1899 | Spoore | 256/35 X |
| 1,764,207 | 6/1930 | Johnson | 52/154 X |
| 1,911,483 | 5/1933 | Thompson | 52/152 |
| 1,924,834 | 8/1933 | Carrel | 52/154 |
| 3,342,444 | 9/1967 | Nelson | 52/154 X |
| 3,727,357 | 4/1973 | Stillman, Jr. | 256/DIG. 5 X |
| 4,349,181 | 9/1982 | Asher et al. | 256/22 X |
| 4,479,636 | 10/1984 | King | 256/22 X |

FOREIGN PATENT DOCUMENTS

| | | | |
|---|---|---|---|
| 274749 | 1/1966 | Australia | 256/65 |
| 1131991 | 5/1955 | France | 256/22 |

*Primary Examiner*—Randolph A. Reese
*Assistant Examiner*—Peter M. Cuomo
*Attorney, Agent, or Firm*—Glen M. Burdick

[57] ABSTRACT

A unitary fence corner post assembly having a brace member welded to medial portions of a main post to extend laterally therefrom and a strut welded between the main post and brace member. The main post, brace member, and strut are constructed of square steel tubing and a steel first stabilization plate is welded to the main post and brace member to extend along the main post from the brace member substantially three-quarters of the distance between the brace member and the lower end of the main post. A notch is formed in the upper edge of the first stabilization plate to extend a distance along the main post and the assembly further includes a second stabilization plate extending through the notch and welded to the main post, the brace member and the first stabilization plate. An end portion of the brace member is downturned and and square anchor plates are welded to the extensive end of the brace member and to the lower end of the main post.

5 Claims, 2 Drawing Sheets

FENCE CORNER POST

BACKGROUND OF THE INVENTION

1. Field of the Invention

The present invention relates generally to improvements in fence posts and, more particularly, but not by way of limitation, to improvements in fence posts constructed for emplacement at the corner of a fence.

2. Brief Description of the Prior Art

In a fence of the type in which several strands of wire are strung on spaced posts, a post at a corner of a fence is subjected to a static force that often can be of the order of several thousand pounds. Such force, which arises from the tension in the wire and the change in direction of the fence at a corner, must be counteracted if the fence is to remain standing and a variety of methods have been employed for this purpose. For example, one method is to cement in portions of the post that are extended into the ground. However, such approach is both expensive and time consuming because of the cost of the cement and the time needed to mix the cement in the field.

Alternatively, bracing of the corner post has been practiced. As in the case of cementing, this method is also time consuming and, additionally, does not reach a second problem experienced with fencing. A fence is a dynamic system so that the corner post is subject to varying forces, as well as the static load, that can, over a period of time result in the post becoming loose in the hole in which it is set so that upkeep of the fence becomes a problem.

Because of these problems, inventors have devoted considerable time and effort to developing fence posts that will remain in place once the post has been set into the ground and a variety of posts have been developed. However, such efforts have often resulted in complex systems that are expensive to manufacture and must be assembled in the field so that, while the structural integrity of the fence might be maintained, the cost in time and money to achieve the structural integrity is again exhorbitant. In general, no inexpensive, easily emplaced corner post capable of supporting the static load exerted thereon without working loose over a period of time has been developed prior to the present invention. It is to these ends that the present invention is directed.

SUMMARY OF THE INVENTION

The present invention provides a lightweight, unitarily constructed fence corner post assembly that supports both static and dynamic loads without working loose and at the same time is both inexpensive to manufacture and quickly and easily emplaced. To these ends, the corner post assembly of the present invention is comprised of a steel main post to which is welded a laterally extending steel brace member having a body portion that can be positioned along the earth's surface, and is itself braced by a strut welded between the main post and the brace member, and a downturned leg portion. In use, lower portions of the main post and the leg portion of the brace member are emplaced in parallel post holes so that the brace member absorbs the static load on the main post arising from the tension in the wires constituting the fence.

To counteract dynamic loads which have, in the past, resulted in posts working loose in the ground, the post assembly has a plurality of stabilization plates, each of which is inexpensively provided by welding of the plates to the main post and to the brace member, that are located to enter the post holes and coact with backfill in the postholes to counteract any tendency of the main post and brace member to twist or wobble in the ground. Thus, the corner post assembly can be rapidly and easily emplaced by inserting lower portions of the main post and the leg portion of the brace member in holes dug for the purpose and packing the holes with soil. Once emplaced, the unitary construction of the assembly, in addition to minimizing manufacturing costs, provides a rigidity that maintains the main post in a proper support position in the absence of any working loose of the assembly in the post holes and the stabilization plates counteract dynamic loads that might cause the main post to work loose.

An important object of the present invention is to provide a fence corner post assembly that combines rigid support of the corner of a fence with economy of manufacture.

Another object of the invention is to provide an inexpensive fence corner post assembly that enables the construction of a fence that is substantially maintenance free for extended periods of time.

Still another object of the invention is to provide a rigid, economically manufactured fence corner post assembly that can be rapidly and easily set into the ground.

Other objects, advantages and features of the present invention will become clear from the following detailed description of the invention when read in conjunction with the drawings and appended claims.

DESCRIPTION OF THE PREFERRED EMBODIMENT

In discussing the construction of the fence corner post assembly of the present invention, it will be useful to consider the dimensions of a typical assembly. While these dimensions are not limiting, it is believed that their presentation will provide a frame of reference from which the construction and use of the assembly can be better understood.

Figure 1:
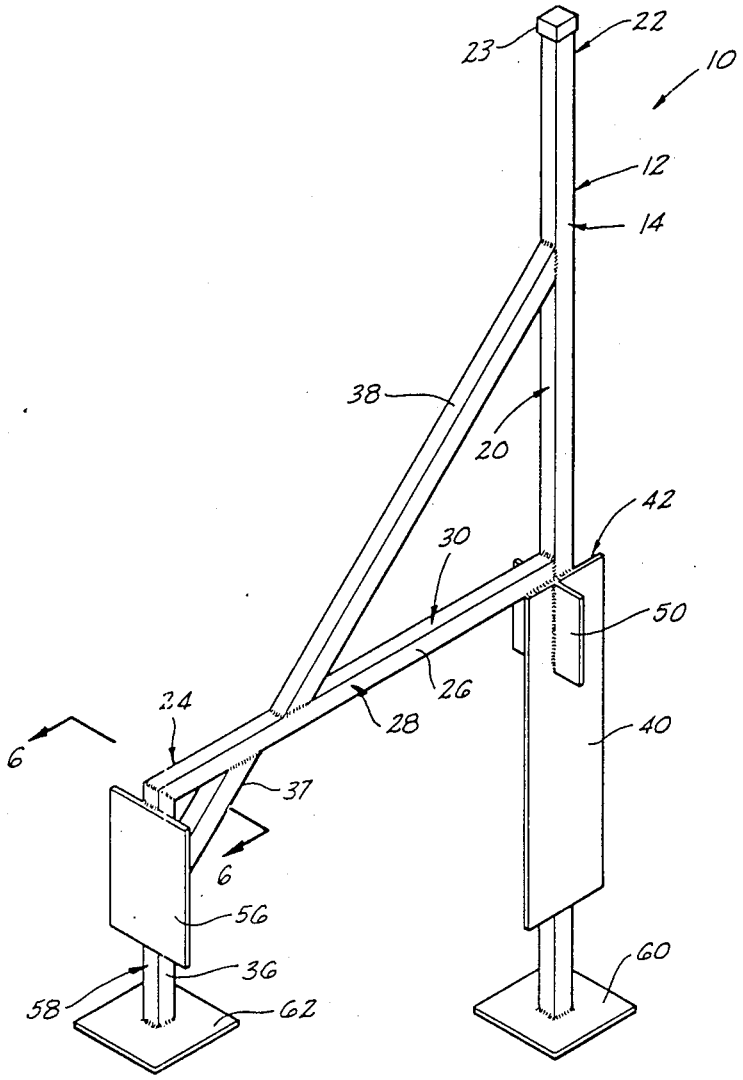
FIG. 1 is an isometric view of a fence corner post assembly constructed in accordance with the present invention.

Referring to FIG. 1, the fence corner post assembly, designated by the general reference numeral 10, is comprised of a main post 12 constructed of square steel tubing which, in a typical assembly in which the main post 12 is eight and a half feet long, suitably can be fourteen gauge, two inch by two inch tubing. As illustrated in the drawings, the main post 12 thus has four plane sides, 14 through 20 (see also FIGS. 2 through 5), extending between an upper end 22 of the main post 12 and a lower end (not numerically designated in the drawings) thereof. As will become clear below, the choice of square tubing for the main post 12 facilitates the construction of the assembly 10 and, accordingly, contributes to the minimization of manufacturing costs which is an aspect of the invention.

An end or rain cap 23, desirably fabricated of twelve gauge steel, is connected to the upper end 22 of the main post 12. The use of rain caps are well kown. Thus, no further description of the rain cap 23 or its connection to the main post 12 is believed necessary to enable one to understand the fence corner post assembly 10.

The assembly 10 is further comprised of a brace member 24 which is constructed of square steel tubing to match the tubing of which the main post 12 is constructed. Thus, in the typical case referred to above, the brace member is constructed of fourteen gauge, two inch by two inch square tubing. As shown in FIG. 1, the brace has a body portion 26 to extend laterally from the side 20 thereof. The construction of the brace 24 from square tubing provides the body portion 26 with plane sides 28 through 34 and the matching of the tubing of which the main post 12 and the brace member 24 are constructed facilitates butt welding of the brace member 24 to the main post 12 and the welding of additional elements of the assembly 10 to the main post 12 and brace member 24 as will be noted below. Specifically, it is contemplated that the sides 28 and 32 of the body portion 26 will be positioned to be flush with the sides 14 and 18, respectively, of the main post 12 to permit rapid welding of one end of the body portion 26 to the side 20 of the main post 12 via welds that extend across the sides 28 and 32 and across the top of the body portion 26 as has been particularly illustrated in FIGS. 2, 3 and 5.

In addition to the body portion 26, the brace member is also comprised of a leg portion 36 which is welded to the extensive end of the body portion 26 to depend downwardly therefrom in a substantially parallel relation to the main post 12. In the typical assembly 10 that has been referred to above, suitable lengths for the body portion 26 and leg portion 36 of the brace member 24 are four feet, ten inches and two feet, respectively, and a suitable distance between the upper end 22 of the main post 12 and the brace member 24 is four and one-half feet. Further, the leg portion 36 is desirably fabricated of fourteen gauge material to provide the desired strength to the leg portion 36. Additional strength is provided by a brace 37 welded acros the joint between the body portion 26 and the leg portion 38. In the typical assembly referred to above, the brace 37 is constructed of two inch by two inch square, fourteen gauge tubing and has a length of six inches.

As also shown in FIG. 1, the main post 12 and brace member 24 can be formed into a rigid structure by a strut 38 that is constructed of square steel tubing to match the tubing of which the main post 12 and brace member 24 are fabricated; and the strut 38 is welded between upper portions of the main post 12 and laterally extensive portions of the body portion 26 of the brace member 24. In the typical assembly referred to above, a suitable length for the strut 38 is four feet, six inches; and the ends of the strut 38 are positioned to provide an angle of substantially forty-five degrees between the strut 38 and each of the main post 12 and body portion 26 of the brace member 24.

As will be discussed below, the brace member 24 and strut 38 provide the fence corner post assembly 10 with a capacity for counteracting the static load exerted on fence corner posts but provide little resistance to dynamic loads that could cause the main post 12 to twist or wobble in the ground and work the soil about lower portions thereof to an extent that could, over a period of time, loosen the main post and require resetting of the main post 12. An important aspect of the present invention is the economic prevention of such twisting and wobbling of the main post 12 of the assembly 10 in a manner that will now be described.

With continuing reference to FIG. 1 and with additional reference to FIGS. 2 through 5, the fence corner post assembly 10 is further comprised of a steel first stabilization plate 40 which, in the typical assembly referred to above, is suitably twelve gauge material that is nine inches wide by thirty inches long. As particularly shown in FIGS. 1 through 3, the first stabilization plate 40 is positioned on the side 14 of the main post 12 with an upper edge 42 thereof aligned with the lower side 34 of the body portion 26 of the brace member 24 and with the width of the first stabilization plate 40 substantially centered on the main post 12. Thus, the first stabilization plate 40 projects to opposite sides 16 and 20 of the main post 12 and extends lengthwise from the brace member 24 toward the lower end of the main post 12. In particular, it has been found that a suitable length for the first stabilization plate 40 is substantially three-fourths the distance between the brace member 24 and the lower end of the main post 12, hence the length of thirty-six inches for the first stabilization plate 40 in the typical post assembly 10 referred to above.

Figure 2:
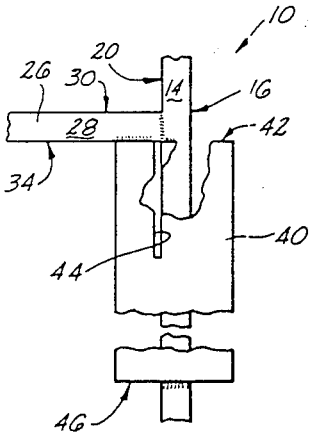
FIG. 2 is a fragmentary side elevational view of an enlarged scale of the main post, brace member and first stabilization plate of the assembly during one stage of manufacture of the assembly.
Figure 3:
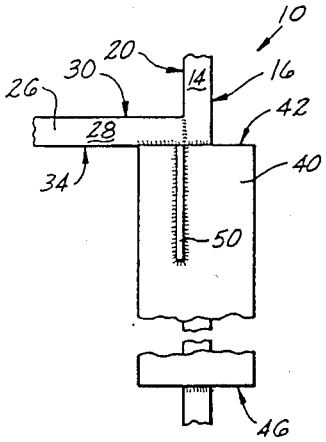
FIG. 3 is a fragmentary side elevational view similar to FIG. 2 illustrating the completed assembly.
Figure 4:
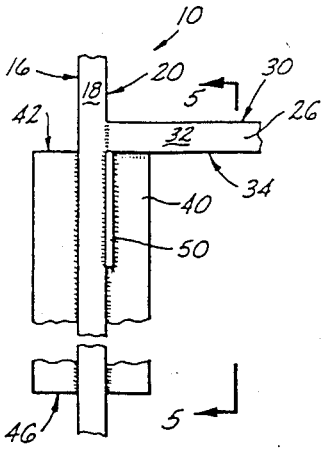
FIG. 4 is a fragmentary side elevational view of the opposite side of the assembly.

As shown in FIG. 2, an elongated notch 44 is formed in the first stabilization plate 40 to extend from the upper edge 42 thereof a selected distance toward a lower edge 46 of the plate 40. In accordance with the invention, the notch 44 is displaced outwardly from the side 20 as has been particularly shown in FIG. 2. With the first stabilization plate 40 so positioned, the plate 40 can be rigidly fixed to the main post 12 and brace member 24 by welding portions of the upper edge of the plate 40 to the brace member 24 and main post 12 as has been shown in FIG. 2, welding portions of the lower edge 46 of the plate 40 to the main post 12 as shown in FIG. 3, and welding the side of the plate 40 in contact with the main post 12 to the sides 16 and 20 of the main post as shown in FIG. 4. As shown in FIG. 4, the weld between the plate 40 and the side 16 of the main post 12 extends the length of the plate 40 and the weld between the plate 40 and the side 20 extends from the lower edge of the plate 40 to the notch 44.

Figure 5:
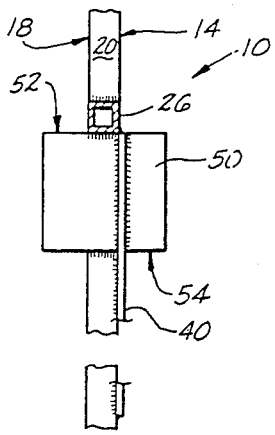
FIG. 5 is a fragmentary cross sectional view taken along line 5 —5 of FIG. 4.

The notch 44 facilitates the rigid attachment of a second stabilization plate 50 to the main post 12 in a manner particularly illustrated in FIGS. 3, 4 and 5. The second stabilization plate 50, like the first stabilization plate 40, can be suitably constructed of twelve gauge steel plate; and a suitable shape for the plate 50 is a square having an edge equal to the length of the notch 44 and also equal to the width of the first stabilization plate 40. Thus, in the typical assembly 10 referred to above, the notch 44 is nine inches long and the second stabilization plate is similarly nine inches square. As shown in FIGS. 3 through 5, the second stabilization plate 50 is positioned in the notch 44 to extend longitudinally along the side 16 of the main post 12 and the plate 50 is laterally centered on the main post 12 so that portions of the stabilization plate 50 extend laterally from opposite sides 14 and 18 of the main post 12. With the second stabilization plate 50 so positioned, the plate 50 can be rigidly secured to remaining portions of the assembly 10 by welding the plate 50 to portions of the outwardly facing side of the plate 40 about the notch 44 (as shown in FIG. 4), welding the side of the plate 50 engaging the side 20 of the main post 12 to the side 18 thereof (as shown in FIG. 4), and welding portions of the upper and lower edges 52 and 54, respectively, of the plate 50 to the underside of the body portion 26 of the brace 24 and the side 20 of the main post 12 (as shown in FIG. 5).

Figure 6:
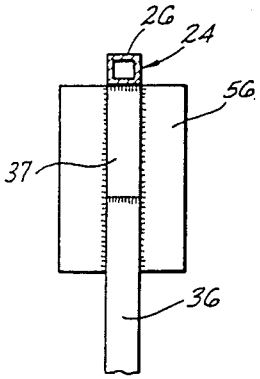
FIG. 6 is a fragmentary cross sectional view taken along line 6 —6 of FIG. 1.

With continuing reference to FIG. 1 and with additional reference to FIG. 6, the fence corner post assembly 10 is further comprised of an additional or third stabilization plate 56, suitably constructed of twelve gauge steel plate, that is positioned on the leg portion 36 of the brace member 24 to extend along the side 58 of the leg portion that faces away from the main post 12. As in the case of the stabilization plates 40 and 50, the stabilization plate 56 is centered on the leg portion 58 so that portions of the plate 56 project from opposite sides of the leg portion 36 (as shown in FIGS. 1 and 6); and the plate 56 extends longitudinally from the underside of the body portion 26 of the brace member 24 toward the extensive end of the leg portion 36. It has been found that a suitable length for the plate 56 is substantially one-half the length of the leg portion 36 so that, in the typical assembly 10 referred to above, a length of fifteen inches for the plate 56 is suitable. As in the case of the plates 40 and 50, a suitable width of the plate 56 for the selected typical assembly 10 is nine inches.

In addition to the stabilization plates 40, 50 and 56, the fence corner post assembly 10 is provided with first and second anchor plates 60 and 62 that are welded to the lower end of the main post 12 and the extensive end of the leg portion 36 of the brace member 24 as has been illustrated in FIG. 1. For reasons that will become clear below, the anchor plates 60 and 62, which are suitably constructed of fifteen gauge steel plate, are constructed in the form of squares that are symmetrically positioned at the end of the main post 12 and leg portion 62 and, additionally have an edge equal to the widths of the second and third stabilization plates 50 and 56. Thus, in the typical fence corner post assembly 10 referred to above, each of the anchor plates 60 and 62 are nine inches on a side.

Figure 8:
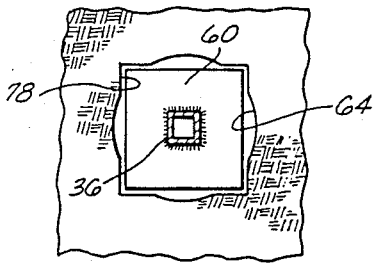
FIG. 8 is a cross sectional view taken along line 8 —8 of FIG. 7.
Figure 7:
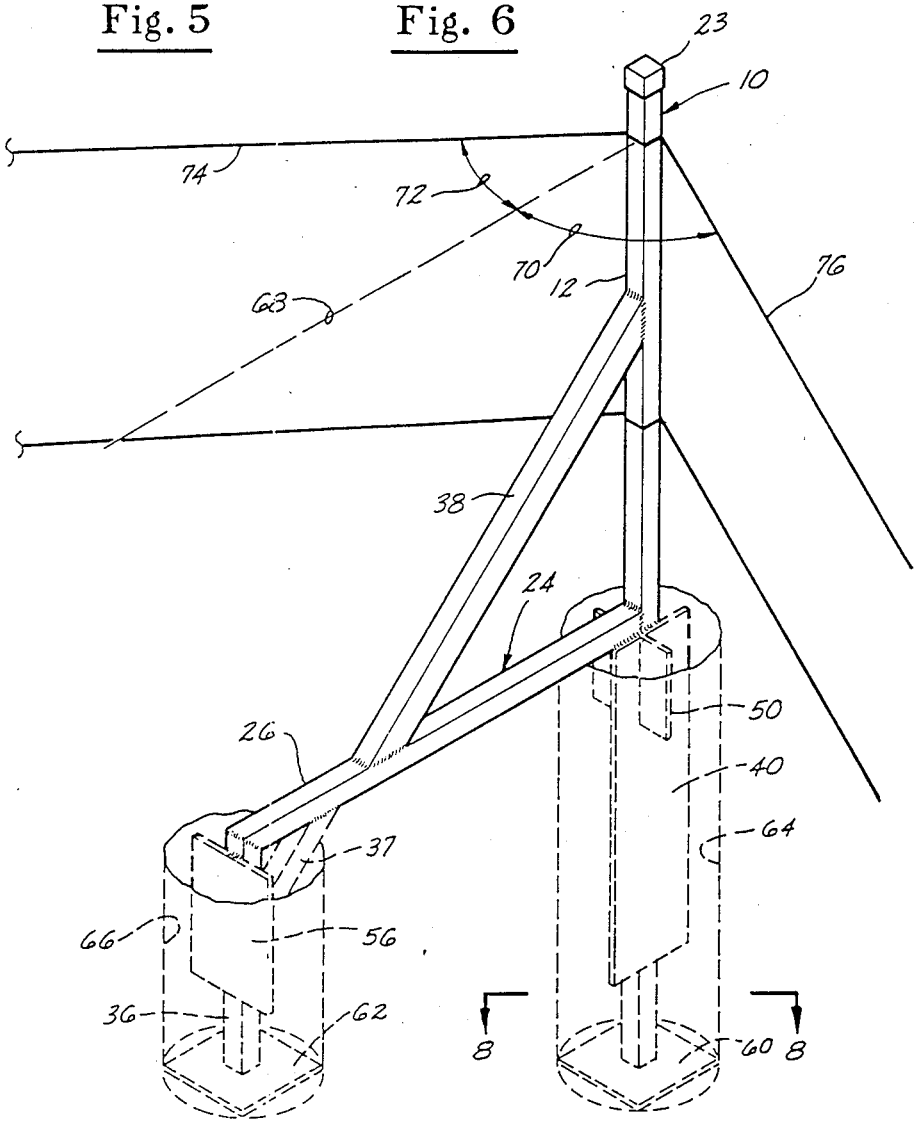
FIG. 7 is an isometric view of the corner post assembly illustrating the emplacement thereof in the construction of a fence.

FIGS. 7 and 8 have been provided to illustrate the emplacement of the fence corner post assembly 10 in the ground. Initially, two holes 64 and 66, spaced a distance equal to the spacing of the main post 12 and leg portion 36 of the brace member 24, are drilled into the earth's surface along a line, shown at 68 near the top of the assembly 10, that makes equal angles 70 and 72 with the directions that segments of a fence to opposite sides of the main post 12 are to take as indicated by wires 74 and 76. The holes 64 and 66, which conveniently can be drilled using a tractor mounted auger, are selected to have depths slightly larger than the length of the portion of the main post 12 below the body portion 26 of the brace member 24 and of the leg portion 36 of the brace member 24. As shown in FIG. 8 for the hole 64, the diameters of the holes 64 and 66 are selected to be equal to or slightly larger than the edge lengths of the anchor plates 60 and 62. As also shown for the hole 64, grooves 78 positioned to receive the corners of the anchor plates 60 and 62, are then cut from the earth's surface to the bottom of the hole 64 to complete initial preparations for emplacement of the post assembly 10. As noted above, the anchor plates 60, 62 and the stabilization plates 40 and 56 have equal widths and this feature of the invention facilitates storage and shipping of the assemblies and, additionally, delivery of the assemblies to the emplacement site in the bed of a light truck. Because of the central attachment of the plates 40, 56, 60 and 62 and the equal widths of such plates, the plates 40, 56, 60 and 62 form a stable base for the assembly 10 when the assembly 10 is laid on its side. Moreover, these characteristics permit ready stacking of a plurality of the assemblies 10 by slightly offsetting consecutive assemblies in the stack. A stack can then be secured with wire to form a compact bundle that can be easily transported or stored.

Once the holes 64 and 66 have been prepared, the assemblies 10 are brought to the field. After adding soil to the holes 64 and 66 to a depth sufficient to cushion the plates 60 and 62, the lower portion of the assembly 10 is inserted into the holes 64 and 66 as shown in FIGS. 7 and 8. That is, the main post 12 is inserted in the hole at the fence line 74 and the leg portion of the brace member is inserted into the hole 66 inside the corner of the fence line. Preferably, the main post 12 is positioned slightly out of plumb with a cant toward the outside of the corner of the fence and the soil removed from the holes 64 and 66 is replaced. Replacement of the soil can be carried out in a number of steps with tamping of the soil after each part of the soil is backfilled. Thus, in the case of the typical assembly 10 that has been referred to above, tamping will occur after each six inches of soil has been introduced into the holes 64 and 66; and a suitable cant of the main post 12 in this case is about three inches. However, it has been found that tamping can also be carried out after filling the holes 64 and 66 halfway and after complete filling if the cant of the main post 12 is made approximately six inches.

After the post assembly 10 has been set into the ground, the fence wires are attached and tightened to pull the main posts 12 into plumb and to finally set the post assembly 10 in the earth. With the assembly 10 so set, the equalality of the angles 70 and 72 between the line 68 and the wires 74 and 76, respectively, results in a net force on the assembly 10 that parallels the brace member 24 so that the brace member 24 absorbs the static force on the assembly 10. For example, for the typical assembly described above, movement of the main post 12 in the direction of the net force exerted by the wires 74 and 76 would require concurrent movement of the large surfaces on the second and third stabilization plates 50, 56 and on the anchor plates 60, 62, as well as the body portion 26 of the brace 24, through the soil. In the typical assembly described, such movement would require displacement of over four hundred square inches of flat surface area through soil down to a depth of four feet.

Dynamic loads on the main post 12, which might cause twisting of the main post 12 in the hole 64 and thereby eventually loosen the main post 12 in the earth are counteracted by the stabilization plates 40 and 50 and by the square construction of the anchor plate 60. Similarly, twisting of the leg portion 36 of the brace member 24 is prevented by the stabilization plate 56 and anchor plate 62. Wobbling of the main post 12 laterally of the brace member 24 is prevented by the first stabilization plate 40 and the anchor plates 60 and 62. Longitudinal wobbling is similarly prevented by the stabilization plates 50 and 56 and the anchor plates 60 and 62. Thus, once the assembly 10 has been emplaced all loads that might cause the main post 12 to become out of plumb or become lose in the hole 64 are counteracted to provide a corner post that is easily emplaced and substantially free of upkeep.

It will be clear that the present invention is well adapted to carry out the objects and attain the ends and advantages mentioned as well as those inherent therein. While a presently preferred embodiment of the invention has been described for purposes of this disclosure, numerous changes may be made which will readily suggest themselves to those skilled in the art and which are encompassed within the spirit of the invention disclosed and as defined in the appended claims.

What is claimed is:

1. A fence corner post assembly comprising:

a steel main post fabricated of square steel tubing and having an upper end, medial portions and a lower end;

a steel brace member welded to the medial portions of the main post, the brace member fabricated of square steel tubing and having a body portion extending substantially perpendicularly from one side of the main post and a downturned leg portion extending substantially parallel to the main post;

a steel strut welded to upper portions of the main post and the body portion and extending therebetween, whereby the main post, brace member and strut are formed into a rigid, generally planar structure;

a steel first stabilization plate welded to the main post and the body portion of the brace member, the first stabilization plate projecting laterally from opposite sides of the main post in the plane formed by the main post, brace member and strut to extend downwardly from the body portion of the brace member a selected distance along the main post toward the lower end thereof;

a steel additional stabilization plate welded to the leg portion of the brace member to project laterally to opposite sides thereof in a substantially perpendicular relation to the plane formed by the main post, the brace member and the strut and to extend along the leg portion a distance from the body portion toward the extensive end of the leg portion;

a steel first anchor plate welded to the lower end of the main post; and a steel second anchor plate welded to the extensive end of the leg portion of the brace member.

2. The fence corner post of claim 1 wherein the first and second anchor plates are square, the main post is welded in a substantially perpendicular relation to a central portion of the first anchor plate and the leg portion of the brace member is welded in a substantially perpendicular relation to a central portion of the second anchor plate.

3. The fence corner post of claim 1 further comprising a rain cap mounted on the upper end of the steel main post.

4. A fence corner post assembly comprising:

a steel main post having an upper end, medial portions and a lower end;

a steel brace member welded to medial portions of the main post, the brace member having a body portion extending substantially perpendicularly from one side of the main post and a downturned leg portion extending substantially parallel to the main post;

a steel strut welded to upper portions of the main post and the body portion and extending therebetween, whereby the main post, brace member and strut are formed into a rigid, generally planar structure;

a steel first stabilization plate welded to the main post and the body portion of the brace member, the first stabilization plate projecting laterally from opposite sides of the main post in the plane formed by the main post, brace member and strut to extend downwardly from the body portion of the brace member a selected distance along the main post toward the lower end thereof, the first stabilization plate having a notch formed in portions thereof adjacent the main post and the brace member;

a steel second stabilization plate extending through the notch of the first stabilization plate to extend perpendicularly from both sides of the first stabilization plate and welded to the main post and the first stabilization plate;

a steel third stabilization plate welded to the leg portion of the brace member to project laterally to opposite sides thereof in a substantially perpendicular relation to the plane formed by the main post, the brace member and the strut and to extend along the leg portion a distance from the body portion toward the extensive end of the leg portion.

5. The fence corner post assembly of claim 4 further comprising a rain cap mounted on the upper end of the steel main post.

* * * * *